US005157013A

United States Patent [19]

Sakai

[11] Patent Number: 5,157,013

[45] Date of Patent: Oct. 20, 1992

[54] HEAT TRANSFER IMAGE-RECEIVING MATERIAL

[75] Inventor: Takeo Sakai, Kanagawa, Japan

[73] Assignee: Fuji Photo Film Co., Ltd., Kanagawa, Japan

[21] Appl. No.: 582,587

[22] Filed: Sep. 14, 1990

[30] Foreign Application Priority Data

Sep. 14, 1989 [JP] Japan ..... 1-239272
Oct. 11, 1989 [JP] Japan ..... 1-264778

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,720,480 1/1988 Ito et al. ..... 503/227

4,871,715 10/1989 Harrison et al. ..... 503/227

*Primary Examiner*—B. Hamilton Hess

*Attorney, Agent, or Firm*—Sughrue, Mion, Zinn, Macpeak & Seas

[57] ABSTRACT

A novel heat transfer image-receiving material is disclosed, comprising a support having thereon at least one image-receiving layer capable of accepting a dye moved from a heat transfer dye-providing material upon heating to form an image, wherein said image-receiving layer comprises a composition comprising a dye-accepting substance dispersed in a water-soluble binder, and the uppermost layer constituting the image-receiving surface of said image-receiving material comprises a co-dispersion of (a) an ultraviolet light absorbent and/or a silicone compound and (b) a plasticizer having an (organic property/inorganic property) value of 1.5 or more.

10 Claims, No Drawings

HEAT TRANSFER IMAGE-RECEIVING MATERIAL

FIELD OF THE INVENTION

The present invention relates to a heat transfer image-receiving material for heat transfer recording. More particularly, the present invention relates to a heat transfer image-receiving material which provides a high image density and exhibits an excellent image preservability.

BACKGROUND OF THE INVENTION

In recent years, with the rapid development in the information industry, various data processing systems have been developed. Recording methods and apparatus suitable for these data processing systems have accordingly been developed and employed. Among these recording methods, the heat transfer recording system employes a light-weight, compact and noiseless apparatus which can be easily operated with little maintainance. In this system, color data can also be dealt with. In recent years, this recording system has been widely used. The heat transfer recording system can be roughly divided into two types, i.e., the heat melt type and the heat mobile type. In the latter type of heat transfer recording system, heat is applied in a predetermined pattern to a lamination of a heat transfer dye-providing material comprising (a) a support having thereon a dye-providing layer containing a binder and a heat-mobile dye with (b) a heat image-receiving material, from the dye-providing material support side. The heat-mobile dye is thereby transferred to the recording medium (heat transfer image-receiving material) in the predetermined pattern to obtain a transfer image.

The term "heat-mobile dye" as used herein means a dye capable of being transferred from a heat transfer dye-providing material to a heat transfer image-receiving material by sublimation or diffusion in the medium.

The heat transfer image-receiving material for use in this heat mobile type of heat transfer recording system normally comprises an organic solvent-soluble polymer. However, the use of organic solvents is not desirable because it causes an increase in the manufacturing cost and harms the health of workers. Therefore, the use of water-dispersed polymers has been attempted. However, these water-dispersed polymers cannot provide a sufficient reception of dyes. Therefore, in order to obtain a high density transfer image, an excessive amount of heat is required for transfer, causing deterioration in the durability of a thermal head.

In order to obtain a high transfer density, the incorporation of a polymer such as polyvinylpyrrolidone and hydroxyethyl cellulose in a saturated polyester have been proposed as disclosed in JP-A-57-107885 and JP-A-57-137191 (the term "JP-A" as used herein means an "unexamined published Japanese patent application"). However, this approach does not take into consideration the preservability of the resulting transfer image under irradiation with light (light resistance). In other words, when the transfer image is stored under a room fluorescent light over an extended period of time or exposed to sunshine, it often suffers from a drastic drop in image density or a remarkable discoloration. It has heretofore been known that an ultraviolet light absorbent may be incorporated in an image-receiving material to improve the light resistance thereof as disclosed in JP-A-59-158289, JP-A-60-101090, and JP-A-61-229594. When an ultraviolet light absorbent is singly incorporated in an image-receiving material, it is dispersed entirely in an image-receiving layer. Since a transferred dye is present mainly on the surface of the image-receiving layer, the ultraviolet light absorbent thus incorporated cannot sufficiently attain its effect. When a large amount of such an ultraviolet light absorbent is incorporated in the image-receiving material to improve the light resistance thereof, it causes the dye developed to be easily dispersed, causing a bleeding in the image or heat fusion to an ink sheet.

An image-receiving material comprising a water-dispersed polymer is also disadvantageous in that it often causes heat fusion to the heat transfer dye-providing material during transfer. In order to overcome these disadvantages, various approaches have been proposed. For example, the incorporation of a polymer such as polyvinylpyrrolidone and hydroxyethyl cellulose in a saturated polyester is proposed in JP-A-57-107885 and JP-A-57-137191. Furthermore, JP-A-58-148794, JP-A-58-197089, and JP-A-58-188695 propose the incorporation of finely divided silica grains, synthetic sodium aluminosilicate, light calcium carbonate, etc. in an image-receiving material.

In these approaches, however, it is difficult to provide an image-receiving material which can provide a high-density transfer image and exhibit an excellent film quality inhibiting heat fusion to a heat transfer dye-providing material.

SUMMARY OF THE INVENTION

It is therefore an object of the present invention to provide a heat transfer image-receiving material which enables the reduction in the manufacturing cost and the solution of safety problems through the elimination of the use of organic solvents in the manufacture thereof and provides a high transfer density.

It is another object of the present invention to provide a heat transfer image-receiving material which can provide a transfer image having an excellent light resistance without causing image bleeding and heat fusion to an ink sheet.

It is a further object of the present invention to provide a heat transfer image-receiving material which enables the solution of the above mentioned problems caused by the coating of a dye-providing substance with an organic solvent and can provide a high transfer density.

It is a still further object of the present invention to provide an improved heat transfer image-receiving material which causes no heat fusion to a dye-providing material.

These objects of the present invention are accomplished with a heat transfer image-receiving material comprising a support having thereon at least one image-receiving layer capable of accepting a dye moved from a heat transfer dye-providing material upon heating to form an image, wherein that said image-receiving layer comprises a composition comprising a dye-accepting substance dispersed in a water-soluble binder, and the uppermost layer constituting the image-receiving surface of said image-receiving material comprises a codispersion of (a) an ultraviolet light absorbent and/or a silicone compound and (b) a plasticizer having an (organic property/inorganic property) value of 1.5 or more.

These and other objects of the present invention will become more apparent from the following detailed description and examples.

DETAILED DESCRIPTION OF THE INVENTION

The heat transfer image-receiving material of the present invention comprises a dye image-receiving layer. This image-receiving layer receives a heat-mobile dye which has moved from a heat transfer dye-providing material during printing and comprises a water-soluble binder dispersion of a substance capable of accepting a heat-mobile dye and developing it.

Typical examples of polymers as substances capable of accepting a heat-mobile dye include the following resins:

(a) Resins containing an ester bond:

Examples of these resins include polyester resins obtained by condensation of a dicarboxylic acid component such as terephthalic acid, isophthalic acid, and succinic acid (which may contain substituents such as sulfone group and carboxyl group) with ethylene glycol, diethylene glycol, propylene glycol, neopentyl glycol, bisphenol A, or the like; polyacrylic ester resins or polymethacrylic ester resins such as polymethyl methacrylate, polybutyl methacrylate, polymethyl acrylate, and polybutyl acrylate; polycarbonate resins; polyvinyl acetate resins; styrene acrylate resins; and vinyltoluene acrylate resins. Specific examples of these resins include those described in JP-A-57-21462, JP-A-59-101395, JP-A-62-238790, JP-A-63-7971, JP-A-63-7972, JP-A63-7973, and JP-A-60-294862. As examples of suitable commercially available resins there can be mentioned Vylon 290, Vylon 200, Vylon 280, Vylon 300, Vylon 103, Vylon GK-140, Vylon GK-130, and Vylonal MD-1200 (all produced by Toyobo Co., Ltd.); and ATR-2009 and ATR-2010 (produced by Kao Corporation).

(b) Resins containing a urethane bond:

Polyurethane resins, etc.

(c) Resins containing an amide bond:

Polyamide resins, etc.

(d) Resins containing a urea bond:

Urea resins, etc.

(e) Resins containing a sulfone bond:

Polysulfone resins, etc.

(f) Resins containing a high-polarity bond:

Polycaprolactone resins, styrene-maleic anhydride resins, polyvinyl chloride resins, polyacrylonitrile resins, etc.

In addition to these synthetic resins, a mixture of these resins or a copolymer of these resins can be used.

As the present water-soluble binder there can be used any of various known water-soluble polymers. Particularly preferred among these polymers are water-soluble polymers containing a group capable of undergoing a crosslinking reaction by a film hardener.

Examples of water-soluble polymers which can be used in the present invention include vinyl polymers and derivatives thereof such as polyvinyl alcohol, polyvinylpyridinium, and cationic modified polyvinyl alcohol (as described in JP-A60-145879, JP-A-60-220750, JP-A-61-143177, JP-A-61-235182, JP-A-61-245183, JP-A-61-237681, and JP-A-61-261089); polymers containing an acrylic group such as polyacrylamide, polydimethyl acrylamide, polydimethylamino acrylate, polyacrylic acid and salts thereof, acrylic acid-methacrylic acid copolymer and salts thereof, polymethacrylic acid and salts thereof, and acrylic acid-vinyl alcohol copolymer and salts thereof (as described in JP-A-60-168651 and JP-A-62-9988); natural polymers and derivatives thereof such as starch, oxidized starch, starch acetate, amine starch, carboxyl starch, dialdehyde starch, cation starch, dextrin, sodium alginate, gelatin, gum arabic, casein, pullulan, dextran, methyl cellulose, ethyl cellulose, carboxymethyl cellulose, hydroxyethyl cellulose, and hydroxypropyl cellulose (as described in JP-A-59-174382, JP-A-60-262685, JP-A-61-143177, JP-A-61-181679, JP-A-61-193879, and JP-A-61-287782); synthetic polymers such as polyvinylmethyl ether, maleic acid-vinyl acetate copolymer, maleic acid-N-vinylpyrrolidone copolymer, maleic acid-alkyl vinyl ether copolymers, and polyethyleneimine (as described in JP-A-61-32787, JP-A-61-237680, and JP-A-61-277483), and water-soluble polymers as described in JP-A-56-58869.

Furthermore, various copolymers which have been water-solubilized by a monomer component containing $SO_3^-$ group, $COO^-$ group, $SO_2^-$ group, or the like can be used.

As such a water-soluble binder there can be particularly preferably used gelatin because it can be dried on a set basis, reducing drying load, and it enables an easy simultaneous multilayer coating. As gelatin there can be used any of the following various gelatins and derivatives thereof. Specific examples of these gelatins include lime-treated gelatin, decalcified lime-treated gelatin, acid-treated gelatin, phthalated gelatin, acetylated gelatin, succinated gelatin and derivatives thereof, enzyme-treated gelatin as described in *Bull. Soc. Phot. Japan,* No. 16, page 30 (1966), hydrolyzates of gelatin, and enzymatic decomposition products of gelatin.

If two or more kinds of water-soluble polymers are used as water-soluble binders, they can be previously mixed. Alternatively, a dispersion of an aqueous solution containing a polymer (e.g., aqueous solution of gelatin) may be mixed with an aqueous solution of another polymer.

The water-soluble binder and the accepting substance are used in a weight proportion of the accepting substance to the water-soluble binder of 1 to 20, preferably 2 to 10, particularly 2.5 to 7.

The incorporation of an accepting substance in a water-soluble binder can be accomplished by any of known methods for the dispersion of a hydrophobic substance in a water-soluble polymer. Typical examples of these known dispersion methods include a process which comprises mixing a solution of an accepting substance in an organic solvent immiscible with water with an aqueous solution of a water-soluble binder and subjecting the mixture to emulsification and dispersion; and a process which comprises mixing a latex of an accepting substance (polymer) with an aqueous solution of a water-soluble binder.

Examples of ultraviolet light absorbents which can be incorporated in the present accepting layer include arylic group-substituted benzotriazole compounds (as described in U.S. Pat. No. 3,533,794), 4-thiazolidone compounds (as described in U.S. Pat. Nos. 3,314,794 and 3,352,681), benzophenone compounds (as described in JP-A-46-2784), cinnamic ester compounds (as described in U.S. Pat. Nos. 3,705,805 and 3,707,375), butadiene compounds (as described in U.S. Pat. No. 4,045,229), and benzoxazole compounds (as described in U.S. Pat. No. 3,700,455). Other examples include those described in U.S. Pat. No. 3,499,762 and JP-A-54-48535.

Alternatively, ultraviolet light-absorbing polymers can be used.

The ultraviolet light absorbents which can be preferably used in the present invention are compounds represented by the general formulae (U-1) to (U-IV):

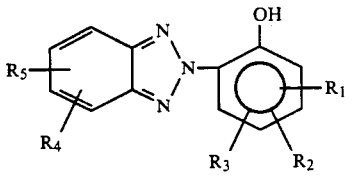
(U-I)

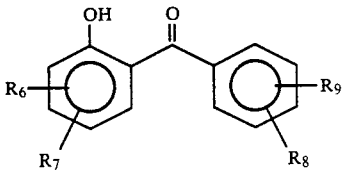
(U-II)

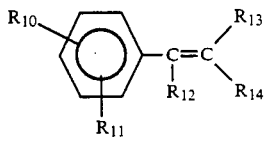
(U-III)

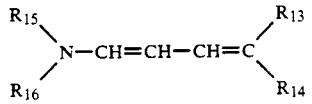
(U-IV)

wherein $R_1$ to $R_5$ may be the same or different and each represents a hydrogen atom, halogen atom, acyloxy group, aliphatic group, aromatic group, $R_{17}O$—, or $R_{17}SO_2^-$; $R_6$ to $R_9$ may be the same or different and each represents a hydrogen atom, halogen atom, hydroxyl group, aliphatic group, aromatic group, carbonamide group, sulfonamide group, sulfo group, carboxy group, or $R_{17}O^-$; $R_{10}$ and $R_{11}$ may be the same or different and each represents a hydrogen atom, aliphatic group, halogen atom, or $R_{17}O^{31}$; $R_{12}$, $R_{15}$, and $R_{16}$ may be the same or different and each represents a hydrogen atom, aliphatic group, or aromatic group (with the proviso that $R_{15}$ and $R_{16}$ are not hydrogen atoms at the same time); $R_{13}$ and $R_{14}$ maybe the same or different and each represents a cyano group, carbamoyl group, sulfamoyl group, formyl group, —$COR_{17}$, —$SOR_{17}$, —$SO_2R_{17}$, —$SO_2OR_{17}$, or —$COOR_{17}$; and $R_{17}$ represents an aliphatic group or aromatic group. The term "aliphatic group" as used herein means a substituted or unsubstituted straight-chain, branched or cyclic alkyl group. The term "aromatic group" as used herein means a substituted or unsubstituted monocyclic or fused benzene ring-containing group.

The ultraviolet light absorbents represented by formulae (U-I), (U-II), (U-III), and (U-IV) to be used in the present invention will be further described hereinafter.

Examples of substituents $R_1$ to $R_{17}$ to be contained in the compounds represented by formulae (U-I) to (U-IV) will be set forth hereinafter.

Examples of substituents $R_1$ to $R_{17}$ include halogen atoms (e.g., fluorine, chlorine, bromine), aliphatic group (e.g., methyl, ethyl, n-propyl, isopropyl, sec-butyl, t-butyl, t-amyl, t-hexyl, n-octyl, 2-ethylhexyl, t-octyl, dodecyl, hexadecyl, trifluoroacetyl, benzyl), aromatic groups (e.g., phenyl, tolyl, 4-methoxyphenyl, naphthyl), acyloxy groups (e.g., acetyloxy, benzoyloxy, p-chlorobenzoyloxy), carbonamide groups (e.g., acetamide, benzamide, trifluoroacetamide), sulfonamide groups (e.g., methanesulfonamide, benzenesulfonamide, toluenesulfonamide), carbamoyl group (e.g., carbamoyl, dimethylcarbamoyl, dodecylcarbamoyl), and sulfamoyl groups (e.g., sulfamoyl, dimethylsulfamoyl, phenylsulfamoyl).

The compounds represented by formulae (U-I) to (U-IV) may be connected to each other via any of the substituents $R_1$ to $R_{17}$ to form a dimer or higher polymer or may be connected to a high-molecular weight main chain via any of the substituents $R_1$ to $R_{17}$ to form a high-molecular weight compound.

Specific examples of the compounds represented by formulae (U-I) to (U-IV) will be set forth below, but the present invention should not be construed as being limited thereto.

UV-1

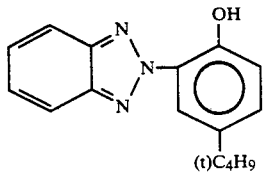

UV-2

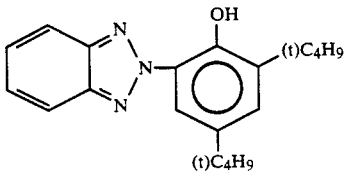

UV-3

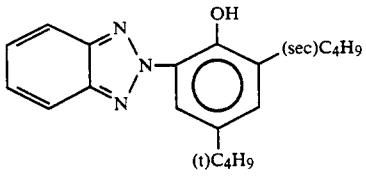

UV-4

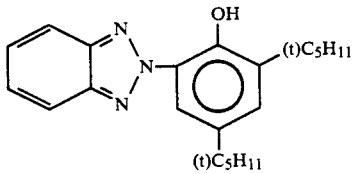

UV-5

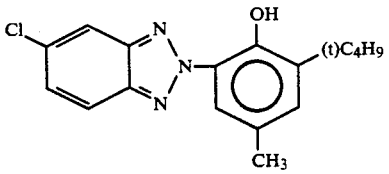

UV-6

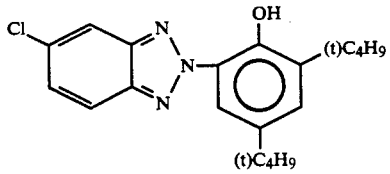

UV-7

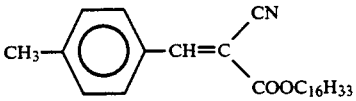

-continued

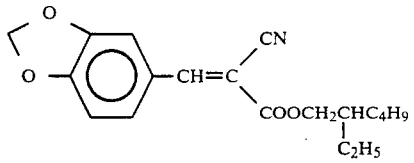

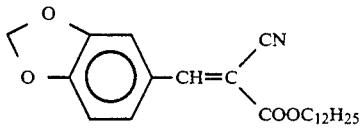

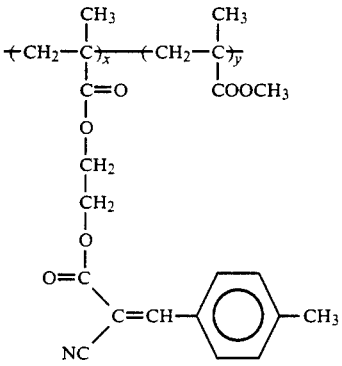

x:y = 7:3 (by weight)

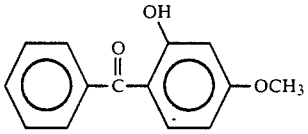

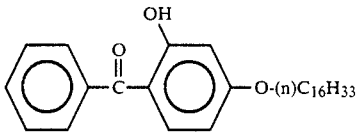

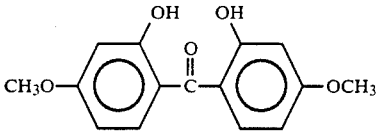

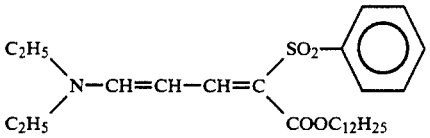

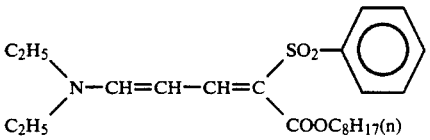

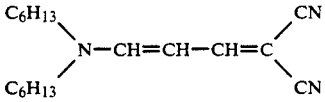

-continued

UV-8

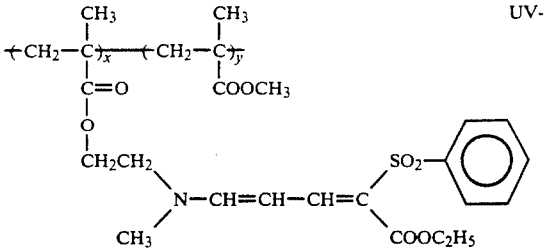

UV-17 x:y = 80:20 (by weight)

UV-9

UV-10

The silicone compound which can be used in the present invention is a compound containing a siloxane bond

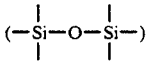

in its molecule. Particularly preferred among these compounds is a silicone oil. As the silicone oil there can be used an unmodified silicone oil. Other examples of silicone oils which can be used in the present invention include olefin-modified, polyether-modified, alcohol-modified, fluoroalkyl-modified, amino-modified, carboxy-modified, epoxy-modified, and mercapto-modified silicone oils. Specific examples of such silicone oils include various modified silicone oils as described in Shin-Etsu Silicone Co., Ltd.'s technical data, *Modified Silicone Oil,* pp. 6–18B. Among these silicone oils, polyether-modified silicone oils and epoxy-modified silicone oils provide desirable effects in the present invention.

UV-11

UV-12

Examples of these modified silicone oils include those having the following skeleton constructions:

(1) Epoxy-modified silicone oils:

UV-13

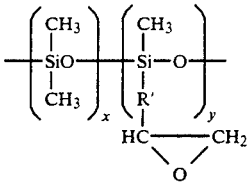

such as

UV-14

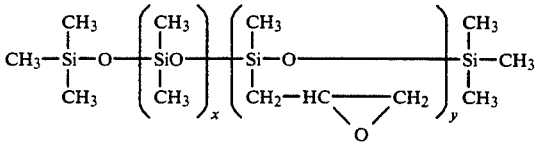

UV-15

(2) Alkyl-modified silicone oils:

UV-16

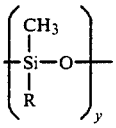

wherein R is an alkyl or aralkyl group, such as

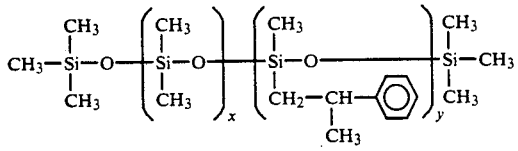

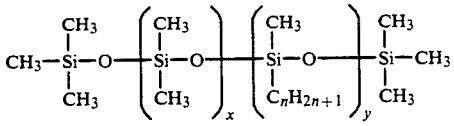

(3) Polyether-modified silicone oils:

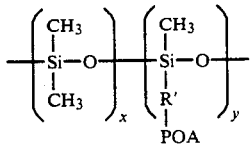

wherein R′ represents a bonding group (e.g., —$CH_2$— (hereinafter the same)); and POA represents a polyoxyalkylene group such as oxyethylene/oxypropylene (hereinafter the same), such as

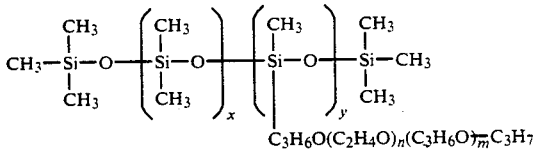

(4) Alcohol-modified silicone oils:

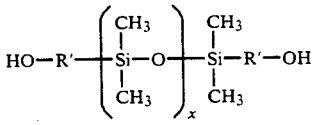

or

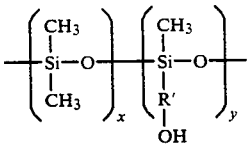

(5) Amino-modified silicon oils:

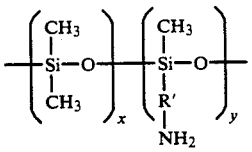

such as

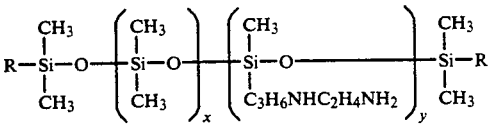

-continued

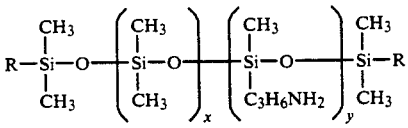

wherein R represents $CH_3$ or $OCH_3$.

(6) Carboxyl-modified silicon oils:

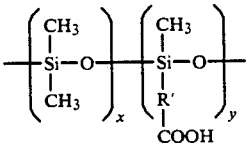

such as

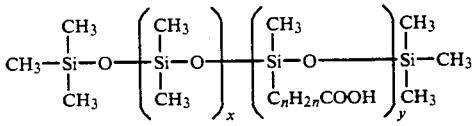

(7) Fluorine-modified silicon oils:

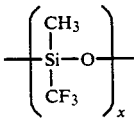

(8) Higher fatty acid-modified silicone oils:

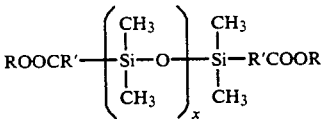

wherein R represents an aliphatic hydrocarbon group.

(9) Epoxy polyether-modified silicone oils:

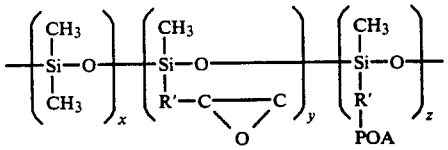

(10) Alkyl polyether-modified silicone oils:

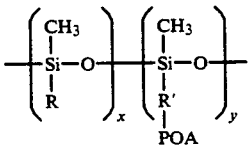

wherein R represents an alkyl group.

In the foregoing formulae, x, y, and z are each 1 or more.

The plasticizer to be used in combination with the ultraviolet light absorbent and/or the silicone compound in the present invention is a compound having an (organic property/inorganic property) value of 1.5 or more, preferably a high boiling organic solvent having a boiling point of at least 180° C. or a compound which has a melting point of 35° to 250 ° C. and is therefore solid at room temperature and capable of being melted when heated by a thermal head during transfer (hereinafter referred to as "thermal solvent"). The terms "organic property" and "inorganic property" as used herein give a concept for the prediction of the properties of compounds.

This concept is further described in *Kagaku no Ryoiki,* Vol. 11, starting on page 719 (1957) as set forth below.

Basically, organic compounds can be considered to be inorganic compounds or specific inorganic elements having chains of methylene groups attached thereto. Hydrocarbons themselves are not exceptional and are compounds in which a methylene chain is sandwiched between hydrogens and may be part of an inorganic compound. With respect to cyclic compounds, unsaturated compounds and the like, the same can be said if such is considered to be in a cyclic form or the unsaturated portion is considered to be a part of the substituent group.

The properties of organic compounds are, as a matter of course, providentially inseparable and are interpreted to be established by two factors: (1) the "organic property" of hydrocarbons based on accumulation of covalent bonds, and (2) the "inorganic property" which is an electrostatic influence present in substituent groups.

The organic property can be compared in terms of the C number and the inorganic property is determined by comparing the boiling point with those of hydrocarbons having the same C number as mentioned above. In order to facilitate graphing, one $CH_2$, where the C number is 1, is taken to have a numeral value of 20, and the organic property is taken to be a multiple thereof. On the other hand, with respect to the inorganic property, while taking the influence of a hydroxyl group against the boiling point to be 100 as a standard, numeral values of other substituent groups (inorganic groups) are each compared therewith and determined as a constant numeral value. Examples are given below.

Free quinine:

Organic property 400, Inorganic property 342

Vitamin $B_1$ (free):

Organic property 280, Inorganic property 580

Nitrocellulose:

[Organic property 300, Inorganic property 170]$_n$ Sodium acetate:

Organic property 40, Inorganic property 650 or more.

Specific examples of these high boiling organic solvents and thermal solvents include esters (e.g., phthalic acid esters, phosphoric acid esters, fatty acid esters), amides (e.g., fatty acid amides, sulfamides), ethers, alcohols, and paraffins as described in JP-A-59-83154, JP-A-59-178451, JP-A-59-178452, JP-A-59-178453,JP-A-59-178454, JP-A-59-178455,JP-A-59-178457, JP-A-62-174754,JP-A-62-245253,JP-A-61-209444, JP-A-61-200538, JP-A-62-8145, JP-A-62-9348, JP-A-62-30247, and JP-A-62-136646.

Specific examples of high boiling organic solvents and thermal solvents which can be used in the present invention will be set forth below, but the present invention should not be construed as being limited thereto. The figure in parenthesis indicates an (organic property/inorganic property) value.

HS-1 (3.27)

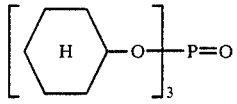

HS-2 $(n\text{-}C_{18}H_{37}O)_3P{=}O$ (13.5)

HS-3 (2.88)

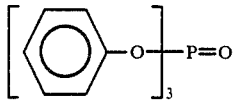

HS-4 (2.58)

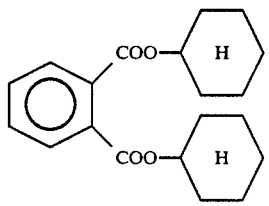

-continued
HS-5 (3.10)
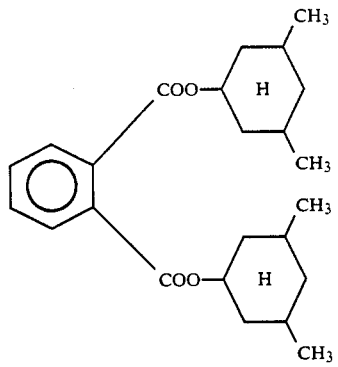
HS-6 (4.13)
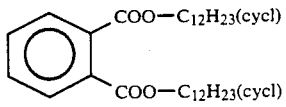
HS-7 (2.42)
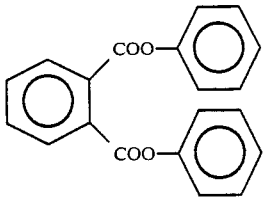
HS-8 (2.31)
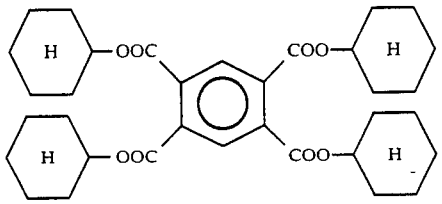
HS-9 (6.13)
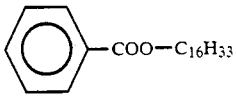
HS-10 (2.27)
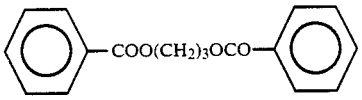
HS-11 (3.41)
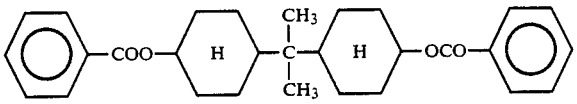
HS-12 (2.13)
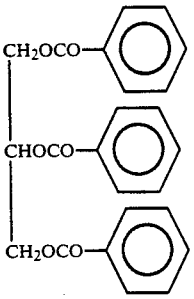

-continued
HS-13 (2.53)
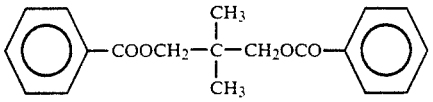
HS-14 (2.20)
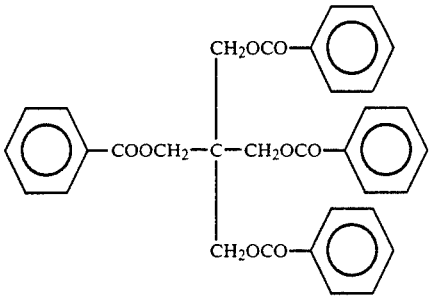
HS-15 (4.19)
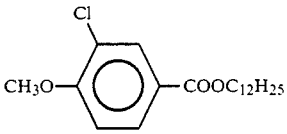
HS-16 $n\text{-}C_{17}H_{35}COOCH_3$ (6.33)
HS-17 (4.67)
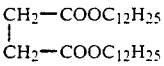
HS-18 (6.77)
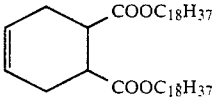
HS-19 (5.54)
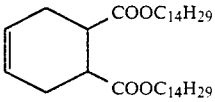
HS-20 (6.77)
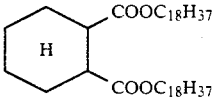
HS-21 (5.54)
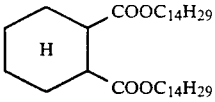
HS-22 $C_{15}H_{31}COOC_{16}H_{33}$ (10.67)
HS-23 (5.87)
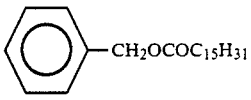
HS-24 (2.25)
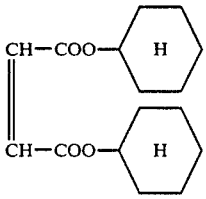

-continued
HS-25 (3.71)
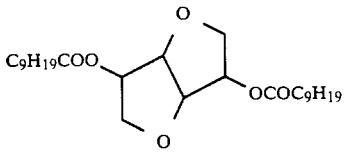
HS-26 (6.33)
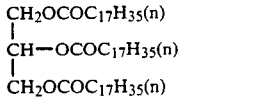
HS-27 (4.33)
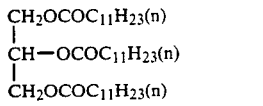
HS-28 (2.56)
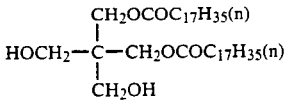
HS-29 (3.29)
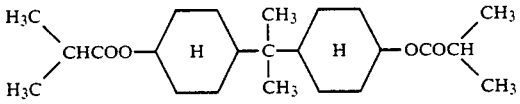
HS-30 (4.00)
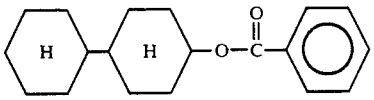
HS-31 (2.54)
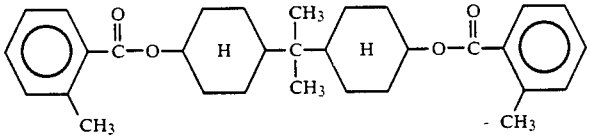
HS-32 $(C_{12}H_{25}O)_3P{=}O$ (5.69)
HS-33 (4.27)
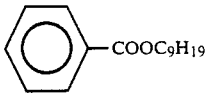
HS-34 (3.46)
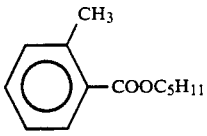
HS-35 (3.36)
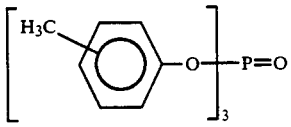
HS-36 (3.37)
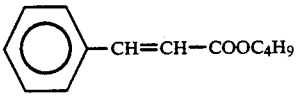
HS-37 (2.91)
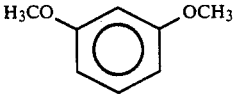

-continued

HS-38 (3.58)

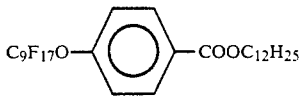

The above mentioned ultraviolet light absorbent and/or silicone compound (a) and plasticizer (b) are incorporated in the uppermost layer in the image-receiving material in the form of codispersion capable of being dispersed in a solvent mainly comprising water. The term "codispersion" as used herein means the state that in an oil-in-water type dispersion, the component (a) and component (b) are present in the same oil droplet. Such a codispersion can be prepared by mixing a solution of the component (a) and the component (b) in a common solvent with an aqueous solution of a water-soluble binder and subjecting the mixture to emulsification and dispersion. During the emulsification and dispersion, an anionic, nonionic, cationic or amphoteric surface active agent can be properly used.

The component (a) and the component (b) are used in a weight proportion of the component (a) to the component (b) of 0.02 to 1.0, preferably 0.05 to 0.75. The codispersion of the component (a) and the component (b) needs to be incorporated in the uppermost layer constituting the image-receiving material. In addition to the uppermost layer, the codispersion may be incorporated in a layer located in the intermediate portion. The codispersion may further be incorporated in layers other than the uppermost layer in such a manner that a dispersion of the component (a) and a dispersion of the component (b) are separately incorporated in these layers. The content of the ultraviolet light absorbent is preferably in the range of 0.5 to 20 parts by weight, particularly 1 to 15 parts by weight, based on 100 parts by weight of the dye-accepting substance contained in the uppermost layer. The content of the silicone compound is preferably in the range of 0.1 to 20 parts by weight, particularly 0.2 to 15 parts by weight, based on 100 parts by weight of the dye-accepting substance contained in the uppermost layer. The content of the plasticizer is preferably in the range of 5 to 40 parts by weight, preferably 7.5 to 30 parts by weight, based on 100 parts by weight of the dye-accepting substance contained in the uppermost layer.

The total thickness of the image-receiving layer is preferably in the range of 1 to 50 μm, particularly 3 to 30 μm. In the case where the image-receiving layer consists of two or more layers, the thickness of the uppermost layer is preferably in the range of 0.1 to 10 μm, particularly 0.2 to 6 μm.

The support to be incorporated in the present heat transfer image-receiving material is not specifically limited. Any of the known support materials can be used in the present invention. In the present invention, a material having a high dispersibility to a heat-mobile dye can be used as the support.

Specific examples of these support materials include (i) synthetic papers (e.g., polyolefin, polystyrene); (ii) paper supports (e.g., wood-free paper, art paper, coated paper, cast-coated paper, wall paper, backing paper, synthetic resin-impregnated paper, emulsion-impregnated paper, synthetic rubber latex-impregnated paper, synthetic resin-incorporated paper, paper board, cellulose fiber paper, polyolefin-coated paper (particularly polyethylene double-coated paper)), and (iii) various plastic films or sheets of polyolefins, polyvinyl chloride, polyethylene terephthalate, polystyrene, polymethacrylate, polycarbonate, etc., and films or sheets obtained by treating these plastic films or sheets so that they are provided with white reflectivity.

Alternatively, a lamination of an arbitrary combination of support materials (i), (ii), and (iii) can be used.

Particularly preferred among these support materials is polyolefin-coated paper because it is not susceptible to indentation deformation due to heating during transfer, exhibits an excellent whiteness, and causes little curling.

Polyolefin-coated paper is futher described in *Shashin Kogaku no Kiso (silver salt system photography edition),* Nihon Shashin Gakkai, Corona Publishing Co., Ltd., pp. 223–240, 1979. This polyolefin-coated paper basically consists of a support sheet and a polyolefin layer coated on the surface thereof. The support sheet comprises a material other than synthetic resins. As such a support sheet there is normally used wood-free paper. The polyolefin coat may be provided on the surface of the support sheet in any manner so far as it adheres closely to the surface of the support sheet. In general, an extrusion process is used. The polyolefin-coated layer may be provided only on the surface of the accepting layer side of the support sheet but may be provided on both the two sides of the support sheet. Examples of polyolefins to be used in the present invention include high-density polyethylene, low-density polyethylene, and polypropylene. Any of these polyolefins may be used. In view of desirability of thermal insulation effect during transfer, the accepting layer side of the support sheet is preferably coated with low-density polyethylene having a lower thermal conductivity than others.

The thickness of the polyolefin coat is specifically limited but normally is preferably in the range of 5 to 100 μm on one side. In order to provide a higher transfer density, it is preferred that the thickness of the polyolefin coat on the accepting layer side is small. The polyolefin coat may comprise a pigment such as titanium oxide for increasing whiteness and ultramarine, a filler, or the like. Furthermore, the polyolefin-coated paper may comprise a gelatin layer having a small thickness as 0.05 to 0.4 g/m$^2$ on its surface (accepting layer side and/or opposite side).

The present heat transfer image-receiving material may comprise an interlayer between the support and the image-receiving layer.

The interlayer may serve as a cushion layer, a porous layer, a heat-mobile dye dispersion-inhibiting layer, or a mixture of two or more of these layers depending on its constituting material. In some cases, the interlayer may also serve as an adhesive.

The heat-mobile dye dispersion-inhibiting layer serves to inhibit a heat-mobile dye from being dispersed into the support. As the binder constituting the dispersion inhibiting layer there can be used either a water-soluble binder or an organic solvent-soluble binder. A water-soluble binder may be preferably used. Examples of such a water-soluble binder include those described with reference to the accepting layer. Particularly preferred among these binders is gelatin.

The porous layer serves to inhibit the heat applied during heat transfer from being dispersed into the support, making the effective use of the heat applied.

If as the binder to be incorporated in the porous layer there is used a water-soluble polymer, the porous layer can be prepared by any process such as (1) a process which comprises dispersing finely divided porous grains in a water-soluble polymer, coating the dispersion on a support, and then drying the material, (2) a process which comprises bubbling air in a water-soluble polymer by a mechanical agitation, coating the water-soluble polymer on a support, and then drying the material, (3) a process which comprises applying a water-soluble polymer containing a foaming agent to be foamed before coating and then coating the water-soluble polymer, or allowing the water-soluble polymer to be foamed during coating and drying, and (4) a process which comprises emulsifying and dispersing an organic solvent (preferably a solvent having a higher boiling point than water) in a water-soluble polymer solution and allowing microvoids to be formed during coating and drying.

If an organic solvent-soluble binder is used for such a porous layer, the porous layer can be prepared by any process such as (1) a process which comprises bubbling air in a synthetic resin emulsion such as polyurethane or synthetic rubber latex such as methyl methacrylate-butadiene by a mechanical agitation, coating the solution on a support, and then drying the material, (2) a process which comprises coating a mixture of the above mentioned synthetic resin emulsion or synthetic rubber latex with a foaming agent on a support and then drying the material, (3) a process which comprises coating a mixture of a synthetic resin such as vinyl chloride plastic sol and polyurethane or a synthetic rubber such as styrene-butadiene on a support and heating the material so that it is foamed, and (4) a process which comprises coating on a support a mixture of a solution of a thermoplastic resin or synthetic rubber in an organic solvent with a non-solvent (including those containing water as a main component) which is more difficult to evaporate than the organic solvent and exhibits compatibility with the organic solvent and no solubility in the synthetic resin or synthetic rubber, and then drying the material so that a microporous layer is formed.

If the accepting layer is provided on both sides of the support, the interlayer may be provided on both side of the support or on one side thereof. The thickness of the interlayer is preferably in the range of 0.5 to 50 μm, particularly 1 to 20 μm.

The present heat transfer image-receiving material may comprise an antistatic agent in or on the surface of an image-receiving layer on at least one side thereof. As such an antistatic agent there can be used a surface active agent. Examples of such a surface active agent include cationic surface active agents (e.g., quaternary ammonium salts, polyamine derivatives), anionic surface active agents (e.g., alkyl phosphates), amphoteric surface active agents, and nonionic surface active agents. Other examples of such an antistatic agent include metal oxides such as aluminum oxide and tin oxide. In the construction comprising an image-receiving layer only on one side of a support, an antistatic agent may be also provided on the opposite side.

Finely divided grains of silica, clay, talc, diatomaceous earth, calcium carbonate, calcium sulfate, barium sulfate, aluminum silicate, synthetic zeolite, zinc oxide, lithopone, titanium oxide, etc. may be incorporated in the constituting layers of the present heat transfer image-receiving material such as an image-receiving layer, an interlayer, a protective layer, and a backing layer.

Finely divided silica grains may be preferably incorporated in the water-soluble binder to be contained in the image-receiving layer, particularly the outermost layer. The term "silica" as used herein means silicon dioxide or a substance containing silicon dioxide as a main component. As finely divided silica to be incorporated in the image-receiving layer there can be used those having a mean grain diameter of 10 to 100 mμ and a specific surface area of less than 250 $m^2/g$, more preferably a mean grain diameter of 10 to 50 mμ and a specific surface area of 20 to 200 $m^2/g$. The content of finely divided silica is in the range of 5 to 90% by weight, preferably 10 to 60% by weight, based on the total weight of the layer in which it is incorporated.

In the present invention, the above mentioned image-receiving layer may further comprise a discoloration inhibitor. An oil-soluble discoloration inhibitor may be preferably dissolved in an organic solvent together with a heat-mobile dye-accepting substance, emulsified and dispersed in a water-soluble binder, and then incorporated in the image-receiving layer.

As such a discoloration inhibitor there can be used an antioxidant or a certain kind of metal complex. Examples of such an antioxidant include chroman compounds, coumaran compounds, phenolic compounds (e.g., hindered phenols), hydroquinone derivatives, hindered amine derivatives, and spiroindane compounds. Further, compounds as described in JP-A-61-159364 can be effectively used.

Examples of such a metal complex include compounds as described in U.S. Pat. Nos. 4,241,155, 4,245,018 (3rd column to 36th column), and 4,254,195 (3rd column to 8th column), JP-A-62-174741, JP-A-61-88256 (pp. 27–29), JP-A-1-77045, and JP-A-63-199248.

Examples of useful discoloration inhibitors are described in JP-A-62-215272 (pp. 125–137).

These oxidation inhbitors and metal complexes may be used in combination.

Furthermore, in the present invention, the above mentioned image-receiving layer or interlayer may comprise a fluorescent brightening agent. Examples of such a fluorescent brightening agent include compounds as described in K. Veenkataraman, *The Chemistry of Synthetic Dyes,* vol. 5, Chap. 8 and JP-A-61-143752. Specific examples of such a fluorescent brightening agent include stilbene compounds, coumarin compounda, biphenyl compounds, benzoxazolyl compounds, naphthalimide compounds, pyrazoline compounds, carbostyryl compounds, and 2,5-dibenzoxazole thiophene compounds. Such a fluorescent brightening agent can be used in combination with a discoloration inhibitor.

A film hardener may be incorporated in the constituting layers of the present heat transfer image-receiving material such as the image-receiving layer, interlayer, and backing layer.

Examples of film hardeners which can be used in the present invention include aldehydes (e.g., formaldehyde, glyoxal, glutaraldehyde), N-methylol compounds (e.g., dimethylol urea, methylol dimethyl hydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-ethylene-bis(vinylsulfonyl acetamide), N,N'-trimethylene-bis(-vinylsulfonyl acetamide)), active halogen compounds (e.g., 2,4-dichloro-6-hydroxy-s-triazine), mucohalogenic acids (e.g., mucochloric acid, mucophenoxychloric acid), epoxy compounds, isoxazoles, dialdehyde starch, and 1-chloro-6-hydroxytriazinylated gelatin. Specific examples of such film hardeners are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,490,911, 3,539,644, and 3,543,292, British Patents 676,628, 825,544, and 1,270,578, West German Patents 872,153, 1,090,427, and 2,749,260, JP-B-34-7133, and JP-B-46-1872 (the term "JP-B" as used herein means an "examined Japanese patent publication").

Particularly preferred among these gelatin film hardeners are aldehydes, active vinyl compounds, and active halogen compounds.

The present heat transfer image-receiving material may be used in combination with a heat transfer dye-providing material.

The heat transfer dye-providing material basically comprises a support having thereon a heat transfer layer containing a heat-mobile dye and a binder. The heat transfer dye-providing material can be prepared by dissolving or dispersing a known heat-mobile dye and a binder resin in a proper solvent to obtain a coating solution, coating the solution on one side of a known support for heat transfer dye-providing material to a dry film thickness of about 0.2 to 5 μm, preferably 0.4 to 2 μm, and drying the coated solution to form a heat transfer layer thereon.

If necessary, an antistatic layer as described in EP-A-194106 or a slipping layer as described in JP-A-62-51490 may be provided in the heat transfer image-receiving material.

As a dye useful for the formation of such a heat transfer layer there can be used any of the known dyes for use in heat transfer dye-providing materials. A dye which can be particularly preferably used in the present invention is a dye having a low molecular weight of about 150 to 800. Such a dye is properly selected depending on the transfer temperature, hue, light resistance, solubility, and dispersibility in ink and binder resin, etc.

Specific examples of such a dye include disperse dyes, basic dyes, and oil-soluble dyes. In particular, there can be preferably used Sumikaron Yellow E4GL, Dianix Yellow H2G-FS, Miketon Polyester Yellow 3GSL, Kayaset Yellow 937, Sumikaron Red EFBL, Dianix Red ACE, Miketon Polyester Red FB, Kayaset Red 126, Miketon Fast Brilliant Blue B, and Kayaset Blue 136.

Other examples of dyes which can be preferably used in the present invention include:

yellow dyes as described in JP-A-59-78895, JP-A-60-28451, JP-A-60-28453, JP-A-60-53564, JP-A-61-148096, JP-A-60-239290, JP-A-60-31565, JP-A-60-30393, JP-A-60-53565, JP-A-60-27594, JP-A-61-262191, JP-A-60-152563, JP-A-61-244595, JP-A-62-196186, JP-A-63-142062, JP-A-63-39380, JP-A-62-290583, JP-A-63-111094, JP-A-63-111095, JP-A-63-122594, JP-A-63-71392, JP-A-63-74685, JP-A-63-74688, and JP-A-1-225592 (there is described a dye represented by the general formula:

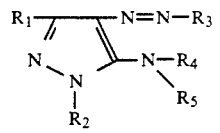

wherein $R_1$ represents a hydrogen atom, alkyl group, alkoxy group, aryl group, alkoxycarbonyl group, cyano group or carbamoyl group; $R_2$ represents a hydrogen atom, alkyl group or aryl group; $R_3$ represents an aryl group or heteryl group; and $R_4$ and $R_5$ may be the same or different and each represents a hydrogen atom or alkyl group, with the proviso that these substituents may be further substituted);

magenta dyes as described in JP-A-60-223862, JP-A-62-28452, JP-A-60-31563, JP-A-59-78896, JP-A-60-31564, JP-A-60-303391, JP-A-61-227092, JP-A-61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-55194, JP-A-62-297593, JP-A-63-74685, JP-A-63-74688, JP-A-62-97886, JP-A-62-132685, JP-A-61-163895, JP-A-62-211190, JP-A-62-99195, and JP-A-1-63194 (there is described a dye of the general formula:

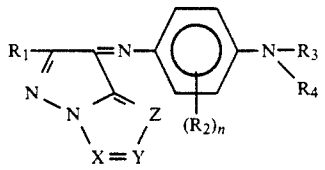

wherein $R_1$ and $R_2$ each represents a hydrogen atom, halogen atom, alkyl group, cycloalkyl group, alkoxy group, aryl group, aryloxy group, aralkyl group, cyano group, acylamino group, sulfonylamino group, ureide group, alkylthio group, arylthio group, alkoxycarbonyl group, carbamoyl group, sulfamoyl group, sulfonyl group, acyl group, or amino group; $R_3$ and $R_4$ each represents an alkyl group, cycloalkyl group, aralkyl group or aryl group, with with proviso that $R_3$ and $R_4$ may be connected to each other to form a ring, $R_2$ and $R_3$ may be connected to each other to form a ring, or $R_2$ and $R_4$ may be connected to each other to form a ring; n represents an integer 0 to 3; and X, Y, and Z each represents a nitrogen atom or

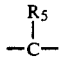

(in which $R_5$ represents a hydrogen atom, alkyl group, cycloalkyl group, aralkyl group, aryl group, alkoxy group, aryloxy group, or amino group), with the proviso that when X and Y, or Y and Z each represents

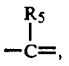

they may be connected to each other to form a saturated or unsaturated carbon ring and that these substituents may be further substituted); and cyan dyes as described in JP-A-59-78894, JP-A-59-227490, JP-A-60-151098, JP-A-59-227493, JP-A-61-244594, JP-A-59-227948, JP-A-60-131292, JP-A-60-

172591, JP-A-60-151097, JP-A-60-131294, JP-A-60-217266, JP-A-60-31559, JP-A-60-53563, JP-A-61-255897, JP-A-60-239239, JP-A-61-22993, JP-A-61-19396, JP-A-61-268493, JP-A-61-35994, JP-A-61-31467, JP-A-61-148269, JP-A-61-49893, JP-A-61-57651, JP-A-60-239291, JP-A-60-239292, JP-A-61-284489, JP-A-62-191191, JP-A-62-138291, JP-A-62-288656, JP-A-63-57293, JP-A-63-15853, JP-A-63-144089, JP-A-63-15790, JP-A-62-311190, JP-A-63-74685, JP-A-63-74688, JP-A-62-132684, JP-A-62-87393, JP-A-62-255187, JP-A-1-20194 (there is described a dye of the general formula:

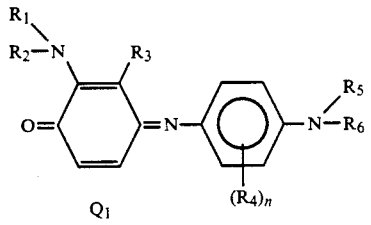

$Q_1$ wherein $Q_1$ represents an atomic group containing at least one nitrogen atom and required to form a 5- or more membered nitrogen-containing heterocycle together with the carbon atoms to which it is connected; $R_1$ represents an acyl group or sulfonyl group; $R_2$ represents a hydrogen atom or $C_{1-6}$ aliphatic group; $R_3$ represents a hydrogen atom, halogen atom, alkoxy group, or $C_{1-6}$ aliphatic group; $R_4$ represents a halogen atom, alkoxy group, or $C_{1-6}$ aliphatic group; and n represents an integer 0 to 4, with the proviso that $R_3$ may be connected to $R_1$, $R_2$, or $R_4$ to form a ring; and $R_5$ and $R_6$ each represents a hydrogen atom, $C_{1-6}$ aliphatic group, or aromatic group, with the proviso that $R_5$ and $R_6$ may be connected to each other to form a ring and that $R_5$ and/or $R_6$ may be connected to $R_4$ to form a ring).

As the binder resin to be used in combination with the above mentioned dye there can be used any known binder resin for use in this purpose. A binder resin which exhibits a high heat resistance and does not inhibit the movement of a dye upon heating can be normally selected. Examples of such a binder resin include polyamide resins, polyester resins, epoxy resins, polyurethane resins, polyacrylic resins (e.g., polymethyl methacrylate, polyacrylamide, polystyrene-2-acrylonitrile), vinyl resins such as polyvinylpyrrolidone, polyvinyl chloride resins (e.g., vinyl chloride-vinyl acetate copolymer), polycarbonate resins, polystyrene, polyphenylene oxide, cellulose resins (e.g., methyl cellulose, ethyl cellulose, carboxymethyl cellulose, cellulose acetate hydrogenphthalate, cellulose acetate, cellulose acetate propionate, cellulose acetate butyrate, cellulose triacetate), polyvinyl alcohol resins (e.g., partially saponified polyvinyl alcohol such as polyvinyl alcohol and polyvinyl butyral), petroleum resins, rosin derivatives, coumaron-indene resins, terpene resins, and polyolefin resins (e.g., polyethylene, polypropylene).

Such a binder resin is preferably used in an amount of about 80 to 600 parts by weight based on 100 parts by weight of the dye.

In the present invention, as an ink solvent for dissolving or dispersing the above mentioned dye and binder resin there can be used any known ink solvent. Specific examples of such an ink solvent include alcoholic solvents such as methanol, ethanol, isopropyl alcohol, butanol, and isobutanol; ketonic solvents such as methyl ethyl ketone, methyl isobutyl ketone, and cyclohexanone; aromatic solvents such as toluene and xylene; halogenic solvents such as dichloromethane and trichloroethane; dioxane; tetrahydrofuran; and mixtures thereof. It is important to select and use such a solvent in such a manner that the dye to be used is dissolved in a predetermined concentration or higher and that the binder resin is sufficienty dissolved or dispersed therein. For example, such a solvent is preferably used in an amount of about 9 to 20 times the sum of the weight of the dye and the binder resin.

The heat transfer dye-providing material thus obtained is then laminated on the present heat transfer image-receiving material. The lamination is heated from any side, preferably from the heat transfer dye-providing material, by a heating means such as a thermal head depending on an image signal. In such an arrangement, a dye in the heat transfer layer can easily be transferred to an accepting layer in the heat transfer image-receiving material depending on the magnitude of the heating energy, providing a color image with an excellent sharpness and gradation.

As a support to be incorporated in the heat transfer dye-providing material there can be used any known support. Examples of such a support include polyesters (e.g., polyethylene terephthalate), polyamides, polycarbonates, glassine paper, capacitor paper, cellulose esters, fluorine polymers, polyethers, polyacetals, polyolefins, polyimides, polyphenylene sulfide, polypropylene, polysulfone, cellophane, and polyamides.

The thickness of the support for heat transfer dye-providing material is normally in the range of 2 to 30 μm. The support may be covered with a subbing layer as necessary. The support may be covered with a slipping layer for inhibiting the sticking of a thermal head to the backside of the dye-providing material. Such a slipping layer comprises a polymer binder-containing or polymer binder-free lubricating substance such as surface active agents, liquid lubricants, and solid lubricants, or mixtures thereof.

The heating means is not limited to a thermal head. Any known heating means such as laser (e.g., semiconductor laser), infrared flash, and heat pen can be used.

In the present invention, the lamination of the heat transfer dye-providing material with the heat transfer image-receiving material enables printing and facsimile in various printers using heat printing process, image printing in magnetic recording process, magneto-optical recording process, optical recording process, etc., printing from television, CRT, etc. and the like.

For details of heat transfer recording process, reference can be made to JP-A-60-34895.

The present invention will be further described in the following examples. In these examples, all parts and percents are by weight unless otherwise indicated.

EXAMPLE 1

Preparation of heat transfer dye-providing material (A)

As a support there was used a 5.5-μm thick polyethylene terephthalate film (Lumirror, available from Toray Industries, Inc.) comprising a heat-resistant slipping layer made of a thermosetting acrylic resin on one side thereof. A coating composition (A) for heat transfer dye-providing layer having the following composition was coated on the side of the support opposite the heat-resistant slipping layer by means of a wire bar in such an amount that the coated amount reached 1 g/m$^2$ after drying to obtain the desired heat transfer dye-providing material (A).

| Coating composition (A) for heat transfer dye-providing layer | |
|---|---|
| Cyan disperse dye (a) of the following general formula | 4 parts |
| Polyvinyl butyral resin (S-Lec BX-1, available from Shimizu Kagaku K.K.) | 4.5 parts |
| Methyl ethyl ketone | 45 parts |
| Toluene | 45 parts |
| Polyisocyanate (Takenate D 110N, available from Takeda Chemical Industries, Ltd.) | 0.2 part |

Cyan disperse dye (a)

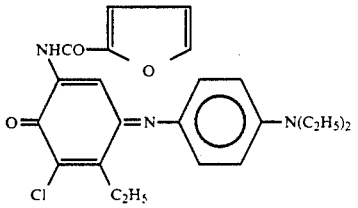

Preparation of heat transfer image-receiving materials (101 to 109)

Image-receiving layer coating solutions having the following compositions were coated on a 200-μm thick photographic polyethylene-coated paper (comprising a 150-μm thick paper laminated with 27-μm thick polyethylene on one side thereof and 23-μm thick polyethylene on the other side thereof and a gelatin subbing layer) in an extrusion coating process in the order of 1st layer and 2nd layer to a dry film thickness of 1 μm and 7.5 μm, respectively, and then dried to prepare image-receiving materials (101 to 107).

| | |
|---|---|
| 1st Layer: | |
| 10% Aqueous solution of gelatin | 100 g |
| Water | 40 ml |
| 4% Aqueous solution of film hardener (1)* | 60 ml |
| 2nd Layer: | |
| 40% Solution of Vylonal MD-1200 (saturated water dispersion of polyester, available from Toyobo Co., Ltd.) | 100 g |
| Dispersion-1 | |
| Ultraviolet light absorbent (1) | (as set forth in Table 1) |
| Plasticizer (1) | (as set forth in Table 1) |
| Ethyl acetate | 16 ml |
| 10% Aqueous solution of gelatin | 100 g |
| 5% Aqueous solution of surface active agent (1)** | 25 ml |
| Water | 53 ml |
| Polyether-modified silicone oil KF-615A (available from Shin-Etsu Chemical Industries Co., Ltd.) | 3 g |
| 5% Aqueous solution of surface active agent (2)*** | 20 ml |
| Water | 345 ml |

As the ultraviolet light absorbent (1) and plasticizer (1) there were used those set forth in Table 1.

Note-1)

*Film hardener (1): 1,2-Bis(vinylsulfoniumacetamide)ethane

**Surface active agent (1): Sodium dodecylbenzenesulfonate

***Surface active agent (2): $C_8H_{17}SO_2N(C_3H_7)CH_2CH_2COOK$

Note-2)

Preparation of Dispersion-1

An ultraviolet light absorbent and a plasticizer are dissolved in ethyl acetate. A mixture of a 10% aqueous solution of gelatin, a surface active agent and water is then added to the solution with stirring. The mixture is then subjected to emulsification and dispersion in a homogenizer at 15,000 rpm over 9 minutes.

Image-receiving materials (108 and 109) were prepared in the same manner as mentioned above, except that as the 2nd layer coating solution there was used the following composition and that an ultraviolet light absorbent was incorporated in the image-receiving layer in a manner different from the present process.

| Coating solution for image-receiving material 108 (2nd layer) | |
|---|---|
| 40% Solution of Vylonal MD-1200 | 100 g |
| Dispersion for image-receiving material 103 (as set forth in Table 1) | 202 g |
| Polyether-modified silicone oil KF-615A | 3 g |
| 10% Solution of ultraviolet light absorbent UV-6 | 25 ml |
| 5% Aqueous solution of surface active agent (2) | 20 ml |
| Water | 320 ml |

| Coating solution for image-receiving material 109 (2nd layer) | |
|---|---|
| 40% Solution of Vylonal MD-1200 | 100 g |
| Dispersion for image-receiving material 103 (as set forth in Table 1) | 202 g |
| Polyether-modified silicone oil KF-615A | 3 g |
| 10% Solution of ultraviolet light absorbent UV-6 | 50 ml |
| 5% Aqueous solution of surface active agent (2) | 20 ml |
| Water | 295 ml |

The heat transfer dye-providing material and heat transfer image-receiving material thus obtained were laminated in such a manner that the dye-providing layer and the image-receiving layer were kept in contact with each other. Printing was conducted on the support side of the heat transfer dye-providing material by means of a thermal head with an output of 0.25 W/dot, a pulse width of 0.15 to 15 msec., and a dot density of 6 dot/mm. Thus, a cyan dye was imagewise developed on the image-receiving layer in the heat transfer image-receiving material.

Evaluation of properties

Maximum density:

The saturated density portion (Dmax) of the heat transfer image-receiving material which had been subjected to recording was measured for reflective density by means of a status A filter.

Bleeding of image:

The heat transfer image-receiving material which had been subjected to recording was stored in a 60° C. incubator over 1 month and then observed for bleeding of image. The evaluation criterion is as follows:

P: Remarkable bleeding observed

F: Slight bleeding observed

G: No bleeding observed

Dye image stability:

The heat transfer image-receiving material which had been subjected to recording was irradiated with a fluorescent light of 15,000 lux over 7 days for examination of dye image stability. The status A filter reflective density was measured before and after irradiation. The ratio of the results (Dmax) obtained before to after irradiation is used for evaluation of stability.

The results are set forth in Table 1.

TABLE 1

| No. | Heat transfer image-receiving material: Ultraviolet light absorbent (1) [Compound/ amount (g)] | | Plasticizer (1) [Compound/ amount (g)] | | Property evaluation: Dmax | Image bleeding | Dye image Stability |
|---|---|---|---|---|---|---|---|
| 101 (Comparison) | — | — | — | — | 0.72 | G | 0.65 |
| 102 (Comparison) | UV-6 | 2.5 | — | — | 0.78 | G | 0.78 |
| 103 (Comparison) | — | — | HS-7 | 10 | 2.25 | G | 0.69 |
| 104 (Invention) | UV-6* | 2.5 | HS-7 | 10 | 2.32 | G | 0.86 |
| 105 (Invention) | UV-2* | 2.5 | HS-4 | 10 | 2.27 | G | 0.84 |
| 106 (Invention) | UV-12* | 2.5 | HS-12 | 10 | 2.35 | G | 0.90 |
| 107 (Invention) | UV-14* | 2.5 | HS-3 | 8 | 2.42 | G | 0.86 |
| 108 (Comparison) | UV-6** | 2.5 | HS-7 | 10 | 2.29 | F | 0.71 |
| 109 (Comparison) | UV-6** | 5.0 | HS-7 | 10 | 2.38 | P | 0.75 |

*The UV light absorbent was used in the form of codispersion with a plasticizer.
**The UV light absorbent was incorporated separately of a plasticizer dispersion.

Table 1 shows that the image-receiving sheets prepared according to the present invention exhibit a high transfer density and an excellent dye image stability and no image bleeding. On the other hand, the image-receiving sheets (108 and 109) which had been prepared by directly incorporating an ultraviolet light absorbent in a coating solution according to the conventional process exhibit a poor dye image stability and an image bleeding.

EXAMPLE 2

| Preparation of water dispersion of polyester A | |
|---|---|
| Solution I: | |
| 10% Aqueous solution of gelatin | 50 g |
| 5% Aqueous solution of surface active agent (2) | 50 ml |
| Water | 40 ml |
| Solution II: | |
| Polyester resin (1) | 40 g |
| Toluene | 60 g |
| Methyl ethyl ketone | 60 g |

Solution II thus prepared was then added to Solution I with stirring. The mixture was subjected to emulsification and dispersion in a homogenizer at 15,000 rpm over 9 minutes to prepare a water dispersion of polyester A.

| Monomer composition (mol %) of polyester resin (1)*: | | | | |
|---|---|---|---|---|
| TPA | IPA | SIPA | BIS-A-BD | BG |
| 25 | 25 | 1 | 24.5 | 24.5 |

Molecular weight: about 20,000 wherein
TPA: terephthalic acid
IPA: isophthalic acid

SIPA:

-continued

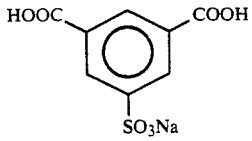

BIS-A-BD:

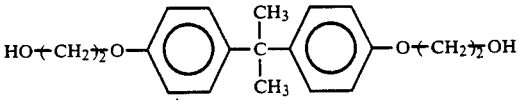

BG: ethylene glycol

Preparation of heat transfer image-receiving materials (201 to 203)

Image-receiving layer coating solutions having the following compositions (the same as used in Example 1 except for the 2nd layer) were coated on the same support as used in Example 1 in an extrusion coating process to a dry film thickness of 1 μm for the 1st layer and 7.5 μm for the 2nd layer, respectively and then dried to prepare image-receiving materials (201 to 203).

| Coating solution for image-receiving material (201) (for 2nd layer) | |
|---|---|
| Water dispersion of polyester A | 300 g |
| Dispersion for image-receiving material 104 in Example 1 | 250 g |
| Polyether-modified silicone oil KF-615A | 3 g |
| 5% Aqueous solution of surface active agent (2) | 20 ml |
| Water | 140 ml |

| Coating solution for image-receiving material (202) (for 2nd layer) | |
|---|---|
| Water dispersion of polyester A | 300 g |
| Dispersion for image-receiving material 106 in Example 1 | 205 g |
| Polyether-modified silicone oil KF-615A | 3 g |
| 5% Aqueous solution of surface active agent (2) | 20 ml |
| Water | 140 ml |

| Coating solution for image-receiving material (203) (for 2nd layer) | |
|---|---|
| Water dispersion of polyester A | 300 g |
| Dispersion for image-receiving material 103 in Example 1 | 205 g |
| Polyether-modified silicone oil KF-615A | 3 g |
| 10% Solution of ultraviolet light absorbent UV-6 | 25 ml |
| 5% Aqueous solution of surface active agent (2) | 20 ml |
| Water | 115 ml |

The image-receiving materials (201 to 203) thus obtained were each laminated on the heat transfer dye-providing material (A) in the same manner as in Example 1. Printing was then conducted on the lamination by means of a thermal head to obtain a cyan dye image. The transfer image thus obtained was then evaluated for maximum density, image bleeding and dye image stability in the same manner as in Example 1. The results are set forth in Table 2.

TABLE 2

| No. | Heat transfer image-receiving material: Ultraviolet light absorbent (1) [Compound/amount (g)] | Plasticizer (1) [Compound/amount (g)] | Property evaluation: Dmax | Image bleeding | Dye image Stability |
|---|---|---|---|---|---|
| 201 (Invention) | UV-6* 2.5 | HS-7 10 | 2.12 | G | 0.88 |
| 202 (Invention) | UV-12* 2.5 | HS-12 10 | 2.19 | G | 0.91 |
| 203 (Comparison) | UV-6** 2.5 | HS-7 10 | 2.08 | F | 0.69 |

Table 2 shows that the image-receiving sheets prepared according to the present invention exhibit excellent transfer density and dye image stability and no image bleeding.

EXAMPLE 3

Preparation of heat transfer dye-providing materials (B and C)

A magenta heat transfer dye-providing material (B) and a yellow heat transfer dye-providing material (C) were prepared in the same manner as in Example 1, except that the cyan disperse dye (a) to be incorporated in the heat transfer dye-providing material (A) was replaced by a magenta disperse dye (b) and a yellow disperse dye (c) of the following formulae, respectively.

Magenta disperse dye (b)

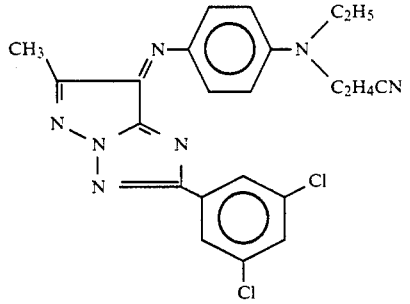

Yellow disperse dye (c)

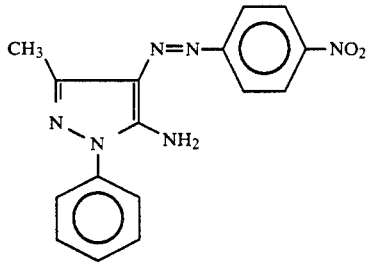

Preparation of heat transfer image-receiving materials (301 to 303)

Image-receiving layer coating solutions having the following compositions were coated on a 150-μm thick synthetic paper (YUPO-FGP-150, available from Oji Yuka Goseishi Co., Ltd.) in an extrusion coating process in the order of the 1st layer, 2nd layer, and 3rd layer to a dry film thickness of 1 μm for the 1st layer, 4 μm for the 2nd layer, and 3.5 μm for the 3rd layer, respectively and then dried to prepare the desired image-receiving materials (301 to 303).

Coating solution for image-receiving material (301) (present invention)

1st Layer: same as the 1st layer in Example 1

2nd Layer: same as the 2nd layer coating solution for image-receiving material 103 in Example 1

3rd Layer: same as the 2nd layer coating solution for image-receiving material 104 in Example 1

Coating solution for image-receiving material (302) (present invention)

1st Layer: same as the 1st layer in Example 1

2nd Layer: same as the 2nd layer coating solution for image-receiving material 103 in Example 1

3rd Layer: same as the 2nd layer coating solution for iage-receiving material 108 in Example 1

Coating solution for image-receiving material (303) (present invention)

1st Layer: same as the 1st layer in Example 1

2nd Layer: same as the 2nd layer coating solution for image-receiving material 103 in Example 1

3rd Layer: same as the 2nd layer coating solution for image-receiving material 109 in Example 1

These image-receiving materials were laminated on each of the heat transfer dye-providing materials (A), (B) and (C). Printing was then conducted on the lamination by means of a thermal head in the same manner as in Example 1 to obtain cyan, magenta and yellow dye images. The transfer images thus obtained were then evaluated for maximum density, image bleeding and dye image stability in the same manner as in Example 1. The results are set forth in Table 3.

TABLE 3

| Image-Receiving material | Dmax: Cyan | Dmax: Magenta | Dmax: Yellow | Image bleeding (cyan) | Dye image stability: Cyan | Dye image stability: Magenta | Dye image stability: Yellow |
|---|---|---|---|---|---|---|---|
| 301 (Invention) | 2.46 | 2.25 | 1.75 | G | 0.85 | 0.82 | 0.92 |
| 302 (Comparison) | 2.33 | 2.21 | 1.70 | F | 0.68 | 0.63 | 0.75 |
| 303 (Comparison) | 2.35 | 2.25 | 1.76 | P | 0.77 | 0.71 | 0.79 |

Table 3 shows that the image-receiving sheet prepared according to the present invention exhibits excellent transfer density and dye image stability and no image bleeding. On the other hand, the image-receiving sheets prepared by incorporating an ultraviolet light absorbent according to the conventional process exhibit a remarkable image bleeding and a poor dye image stability.

EXAMPLE 4

Preparation of heat transfer dye-providing material (D)

As a support there was used a 5.5-μm thick polyethylene terephthalate film (Lumirror, available from Toray Industries, Inc.) comprising a heat-resistant slipping layer made of a thermosetting acrylic resin on one side thereof. A coating composition (D) for heat transfer dye-providing layer having the following composition was coated on the side of the support opposite the heat-resistant slipping layer by means of a wire bar in such an amount that the coated amount reached 1 g/m$^2$ after drying to obtain the desired heat transfer dye-providing material (D).

| Coating composition (D) for heat transfer dye-providing layer | |
|---|---|
| Disperse dye (MS Red G, available from Mitsui Toatsu Chemicals, Inc) (Disperse Red 60) | 3.6 parts |
| Disperse dye (Macrolex Violet R, available from Bayer AG) (Disperse Red 26) | 2.6 parts |
| Polyvinyl butyral resin (S-Lec BX-1, available from Shimizu Kagaku K.K.) | 4.3 parts |
| Methyl ethyl ketone | 45 parts |
| Toluene | 45 parts |

Preparation of heat transfer image-receiving material (401)

Image-receiving layer coating solutions having the following compositions were coated on a 200-μm thick photographic polyethylene-coated paper (comprising a 150-μm thick paper laminated with 27-μm thick polyethylene on one side thereof and 23-μm thick polyethylene on the other side thereof and a gelatin subbing layer) in an extrusion coating process in the order of 1st layer and 2nd layer to a dry film thickness of 1 μm and 7.5 μm, respectively, and then dried to prepare an image-receiving material (401).

| Coating solutions for image-receiving material (401) | |
|---|---|
| 1st Layer: | |
| 10% Aqueous solution of gelatin | 100 g |
| Water | 40 ml |
| 4% Aqueous solution of film hardener (1)* | 60 ml |
| 2nd Layer: | |
| 40% Solution of Vylonal MD-1200 (saturated water dispersion of polyester, available from Toyobo Co., Ltd.) | 100 g |
| 10% Aqueous solution of gelatin | 100 g |
| 5% Aqueous solution of surface active agent (1)** | 20 ml |
| Water | 445 ml |

Image-receiving materials (402 and 407) were prepared in the same manner as mentioned above, except that as the 2nd layer coating solution there was used the following composition.

| Coating solution for image-receiving material (402) | |
|---|---|
| 2nd Layer: | |
| 40% Solution of Vylonal MD-1200 Dispersion-1' | 100 g |
| Polyether-modified silicone oil KF-615A (available form Shin-Etsu Chemical Industry Co., Ltd.) | 3 g |
| Ethyl acetate | 9 ml |
| 10% Aqueous solution of gelatin | 100 g |
| 5% Aqueous solution of surface active agent (2)*** | 25 ml |
| Water | 64 ml |
| 5% Aqueous solution of surface active agent (1) | 20 ml |
| Water | 345 ml |

-continued

| Coating solution for image-receiving material (403) | |
|---|---|
| 2nd Layer: | |
| 40% Solution of Vylonal MD-1200 Dispersion-2' | 100 g |
| Present Compound HS-7 | 8 g |
| Ethyl acetate | 16 ml |
| 10% Aqueous solution of gelatin | 100 g |
| 5% Aqueous solution of surface active agent (2) | 25 ml |
| Water | 53 ml |
| 5% Aqueous solution of gelatin | 20 ml |
| Water | 345 ml |

| Coating solution for image-receiving material (404) | |
|---|---|
| 2nd Layer: | |
| 40% Solution of Vylonal MD-1200 Dispersion-3' | 100 g |
| Present Compound HS-7 | 8 g |
| Polyether-modified silicone oil KF-615A | 3 g |
| Ethyl acetate | 25 ml |
| 10% Aqueous solution of gelatin | 100 g |
| 5% Aqueous solution of surface active agent (2) | 25 ml |
| Water | 41 ml |
| 5% Aqueous solution of surface active agent (1) | 20 ml |
| Water | 345 ml |

| Coating solution for image-receiving material (405) | |
|---|---|
| 2nd Layer: | |
| 40% Solution of Vylonal MD-1200 Dispersion-4' | 100 g |
| Present Compound HS-1 | 8 g |
| Polyether-modified silicone oil KF-615A | 3 g |
| Ethyl acetate | 25 ml |
| 10% Aqueous solution of gelatin | 100 g |
| 5% Aqueous solution of surface active agent (2) | 25 ml |
| Water | 41 ml |
| 5% Aqueous solution of surface active agent (1) | 20 ml |
| Water | 345 ml |

| Coating solution for image-receiving material (406) | |
|---|---|
| 2nd Layer: | |
| 40% Solution of Vylonal MD-1200 Dispersion-5' | 100 g |
| Present Compound HS-4 | 8 g |
| Epoxy.polyether-modified silicone oil SF-8421(available from Toray Silicone Co., Ltd.) | 3 g |
| Ethyl acetate | 25 ml |
| 10% Aqueous solution of gelatin | 100 g |
| 5% Aqueous solution of surface active agent (2) | 25 ml |
| Water | 41 ml |
| 5% Aqueous solution of surface active agent (1) | 20 ml |
| Water | 345 ml |

| Coating solution for image-receiving material (407) | |
|---|---|
| 2nd Layer: | |
| 40% Solution of Vylonal MD-1200 Dispersion-6' | 100 g |
| Present Compound HS-7 | 8 g |
| Ethyl acetate | 16 ml |
| 10% Aqueous solution of gelatin | 50 g |
| 5% Aqueous solution of surface active agent (2) | 15 ml |
| Water | 13 ml |
| Dispersion-7' | |
| Polyether-modified silicone oil KF-615A | 3 g |
| Ethyl acetate | 9 ml |
| 10% Aqueous solution of gelatin | 50 g |
| 5% Aqueous solution of surface active agent (2) | 15 ml |
| Water | 24 ml |

-continued

| | |
|---|---|
| 5% Aqueous solution of surface active agent (1) | 20 ml |
| Water | 345 ml |

Note-1)
*Film hardener (1): 1,2-Bis(vinylsulfoniumacetamide)ethane
**Surface active agent (1): $C_8H_{17}SO_2N(C_3H_7)CH_2CH_2COOK$
***Surface active agent (2): Sodium dodecylbenzenesulfonate
Note-2)
Preparation of Dispersion-1' to Dispersion-7'

A silicone oil and/or a plasticizer of the present invention are dissolved in ethyl acetate. A mixture of a 10% aqueous solution of gelatin, a surface active agent and water is then added to the solution with stirring. The mixture is then subjected to emulsification and dispersion in a homogenizer at 15,000 rpm over 9 minutes.

The heat transfer dye-providing materials and heat transfer image-receiving materials thus obtained were laminated in such a manner that the dye-providing layer and the image-receiving layer were kept in contact with each other. Printing was conducted from the support side of the heat transfer dye-providing material by means of a thermal head with an output of 0.25 W/dot, a pulse width of 0.15 to 15 msec., and a dot density of 6 dot/mm. Thus, a magenta dye was imagewise developed on the image-receiving layer in the heat transfer image-receiving material.

The image-receiving material which had been subjected to recording was then measured for transfer dye density by means of a reflective Macbeth densitometer. The results (Dmax) are set forth in Table 4.

Transfer was then conducted in the same manner as mentioned above, except that the thermal head output was 0.3 W/dot. The heat transfer dye-providing materials were then examined for heat fusion of the dye-providing layer to the image-receiving material.

The evaluation criterion is as follows:

G: No heat fusion

F: Partially heat-fused

P: Significant part heat-fused

The results are set forth in Table 4.

TABLE 4

| Image-receiving material | Dmax | Heat fusion |
|---|---|---|
| 401 (Comparison) | 0.58 | P |
| 402 (Comparison) | 0.67 | F |
| 403 (Comparison) | 1.35 | F |
| 404 (Invention) | 1.72 | G |
| 405 | 1.66 | G |
| 406 (Invention) | 1.69 | G |
| 407 (Comparison) | 1.43 | G |

Table 4 shows that the image-receiving sheets prepared according to the present invention exhibit a high transfer density and no heat fusion. On the other hand, the image-receiving sheets (402 and 403) which singly contain a silicone compound and a plasticizer, respectively, exhibit a low Dmax value and a significant heat fusion. The image-receiving sheet (407) which comprises separate dispersions of silicone compound and plasticizer, exhibits no heat fusion but a low Dmax value.

EXAMPLE 5

| Preparation of water dispersion of polyester A | |
|---|---|
| Solution I: | |
| 10% Aqueous solution of gelatin | 50 g |
| 5% Aqueous solution of surface active agent (2) | 50 ml |
| Water | 40 ml |
| Solution II: | |
| Polyester resin (1) | 40 g |
| Toluene | 60 g |
| Methyl ethyl ketone | 60 g |

Solution II thus prepared was then added to Solution I with stirring. The mixture was subjected to emulsification and dispersion in a homogenizer at 15,000 rpm over 9 minutes to prepare a water dispersion of polyester A.

Monomer composition (mol %) of polyester resin (1)*:

| TPA | IPA | SIPA | BIS-A-BD | BG |
|---|---|---|---|---|
| 25 | 25 | 1 | 24.5 | 24.5 |

Molecular weight: about 20,000 wherein

TPA: terephthalic acid

IPA: isophthalic acid

SIPA:

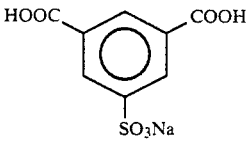

BIS-A-BD:

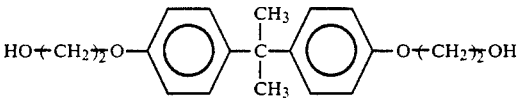

BG: ethylene glycol

Preparation of heat transfer image-receiving materials (501 to 504)

Image-receiving layer coating solutions having the following compositions (the same as used in Example 1 except for the 2nd layer) were coated on the same support as used in Example 1 in an extrusion coating process to a dry film thickness of 1 μm for the 1st layer and 7.5 μm for the 2nd layer, respectively and then dried to prepare image-receiving materials (501 to 504).

| Coating solution for image-receiving material (501) | |
|---|---|
| 2nd layer: | |
| Water dispersion of polyester A | 300 g |
| Dispersion-1' in Example 4 | 200 g |
| 5% Aqueous solution of surface active agent (1) | 20 ml |
| Water | 140 ml |
| Coating solution for image-receiving material (502) | |
| 2nd layer: | |
| Water dispersion of polyester A | 300 g |
| Dispersion-2' in Example 4 | 200 g |
| 5% Aqueous solution of surface active agent (1) | 20 ml |
| Water | 140 ml |
| Coating solution for image-receiving material (503) | |

-continued

| | |
|---|---|
| 2nd layer: | |
| Water dispersion of polyester A | 300 g |
| Dispersion-3' in Example 4 | 200 g |
| 5% Aqueous solution of surface active agent (1) | 20 ml |
| Water | 140 ml |
| Coating solution for image-receiving material (504) | |
| 2nd layer: | |
| Water dispersion of polyester A | 300 g |
| Dispersion-5' in Example 4 | 200 g |
| 5% Aqueous solution of surface active agent (1) | 20 ml |
| Water | 140 ml |

The image-receiving materials (501) and (502) were comparative specimens, and the image-receiving materials (503) and (504) were present specimens. These image-receiving materials obtained were each laminated on the heat transfer dye-providing material in the same manner as in Example 4. Printing was then conducted on the lamination by means of a thermal head to obtain a magenta dye image. The transfer image thus obtained was then measured for maximum density (Dmax) by a reflective Macbeth densitometer and heat fusion. The results are set forth in Table 5.

TABLE 5

| Image-receiving material | Dmax | Heat fusion |
|---|---|---|
| 501 (Comparison) | 0.62 | P |
| 502 (Comparison) | 1.26 | F |
| 503 (Invention) | 1.58 | G |
| 504 (Invention) | 1.53 | G |

Table 5 shows that the image-receiving sheets prepared according to the present invention exhibit a high transfer density and no heat fusion.

EXAMPLE 6

Preparation of heat transfer image-receiving materials (601 to 603)

Image-receiving layer coating solutions having the following compositions were coated on a 150-μm thick synthetic paper (YUPO-FGP-150, available from Oji Yuka Goseishi Co., Ltd.) in an extrusion coating process in the order of the 1st layer, 2nd layer and 3rd layer to a dry film thickness of 1 μm for the 1st layer, 4 μm for the 2nd layer and 3.5 μm for the 3rd layer, respectively and then dried to prepare the desired image-receiving materials (601 to 603).

| | |
|---|---|
| Coating solution for image-receiving material (601) | |
| 1st Layer: | |
| 10% Aqueous solution of gelatin | 100 g |
| Water | 40 ml |
| 4% Aqueous solution of film hardener (1)* | 60 ml |
| 2nd Layer: | |
| 40% Solution of Vylonal MD-1200 | 100 g |
| Dispersion-2' in Example 4 | 200 g |
| 5% Aqueous solution of surface active agent (1)** | 20 ml |
| Water | 345 ml |
| 3rd Layer: | |
| 40% Solution of Vylonal MD-1200 | 100 g |
| Dispersion-1' in Example 4 | 200 g |
| 5% Aqueous solution of surface active agent (1)** | 20 ml |
| Water | 345 ml |
| Coating solution for image-receiving material (602) | |
| 1st Layer: | |
| 10% Aqueous solution of gelatin | 100 g |
| Water | 40 ml |
| 4% Aqueous solution of film hardener (1)* | 60 ml |
| 2nd Layer: | |
| 40% Solution of Vylonal MD-1200 | 100 g |
| Dispersion-2' in Example 4 | 200 g |
| 5% Aqueous solution of surface active agent (1)** | 20 ml |
| Water | 345 ml |
| 3rd Layer: | |
| 40% Solution of Vylonal MD-1200 | 100 g |
| Dispersion-2' in Example 4 | 200 g |
| 5% Aqueous solution of surface active agent (1)** | 20 ml |
| Water | 345 ml |
| Coating solution for image-receiving material (603) | |
| 1st Layer: | |
| 10% Aqueous solution of gelatin | 100 g |
| Water | 40 ml |
| 4% Aqueous solution of film hardener (1)* | 60 ml |
| 2nd Layer: | |
| 40% Solution of Vylonal MD-1200 | 100 g |
| Dispersion-2' in Example 4 | 200 g |
| 5% Aqueous solution of surface active agent (1)** | 20 ml |
| Water | 345 ml |
| 3rd Layer: | |
| 40% Solution of Vylonal MD-1200 | 100 g |
| Dispersion-3' in Example 4 | 200 g |
| 5% Aqueous solution of surface active agent (1)** | 20 ml |
| Water | 345 ml |

The image-receiving materials (601) and (602) were comparative specimens, and the image-receiving material (603) was present specimen. These image-receiving materials obtained were each laminated on the heat transfer dye-providing material in the same manner as in Example 4. Printing was then conducted on the lamination by means of a thermal head to obtain a magenta dye image. The transfer image thus obtained was then measured for transfer dye density (Dmax) by a reflective Macbeth densitometer and heat fusion. The results are set forth in Table 6.

TABLE 6

| Image-receiving material | Dmax | Heat fusion |
|---|---|---|
| 601 (Comparison) | 0.71 | F |
| 602 (Comparison) | 1.39 | F |
| 603 (Invention) | 1.77 | G |

Table 6 shows that the image-receiving sheet prepared according to the present process exhibits a high transfer density and no heat fusion.

While the invention has been described in detail and with reference to specific embodiments thereof, it will be apparent to one skilled in the art that various changes and modifications can be made therein without departing from the spirit and scope thereof.

What is claimed is:

1. A heat transfer image-receiving material comprising a support having thereon at least one image-receiving layer capable of accepting a dye from a heat transfer dye-providing material upon heating to form an image, wherein said image-receiving layer comprises a composition comprising a dye-accepting substance dispersed in a water-soluble binder, and the uppermost layer constituting the image-receiving surface of said image-receiving material comprises a co-dispersion of (a) an ultraviolet light absorbent and/or a silicone compound and (b) a plasticizer having an organic property/inorganic property value of 1.5 or more.

2. A heat transfer image-receiving material as in claim 1, wherein said image-receiving layer and said uppermost layer constituting the image-receiving surface of said image-receiving material are separate layers.

3. A heat transfer image-receiving material as in claim 1, wherein the dye-accepting substance is present in an amount of 1 to 20 times by weight the amount of the water-soluble binder.

4. A heat transfer image-receiving material as in claim 1, wherein said component (a) and said component (b) are used in a weight proportion of said component (a) to said component (b) of 0.02 to 1.0.

5. A heat transfer image-receiving material as in claim 1, wherein the content of the ultraviolet light absorbent is in the range of 0.5 to 20 parts by weight based on 100 parts by weight of the dye-accepting substance contained in the uppermost layer.

6. A heat transfer image-receiving material as in claim 1, wherein the content of the silicone compound is in the range of 0.1 to 20 parts by weight based on 100 parts by weight of the dye-accepting substance contained in the uppermost layer.

7. A heat transfer image-receiving material as in claim 1, wherein the content of the plasticizer is in the range of 5 to 40 parts by weight based on 100 parts by weight of the dye-accepting substance contained in the uppermost layer.

8. A heat transfer image-receiving material as in claim 1, wherein said codispersion comprising a mixture of component (a) and component (b) is in the form of dispersed grains.

9. A heat transfer image-receiving material as in claim 1, wherein said codispersion is prepared by mixing a solution of said component (a) and said component (b) in a common solvent with an aqueous solution of a water-soluble binder and dispersing and subjecting the mixture to emulsification dispersion.

10. A heat transfer image-receiving material as in claim 1, wherein the plasticizer (b) is selected from the group consisting of phthalic acid esters, phosphoric acid esters, fatty acid esters, and glycerin triphthalate.

* * * * *